US010995657B2

(12) United States Patent
McDonald

(10) Patent No.: US 10,995,657 B2
(45) Date of Patent: May 4, 2021

(54) EXTERNALLY POWERED TURBINE FOR AN INTERNAL COMBUSTION ENGINE

(71) Applicant: John Manley McDonald, Folsom, CA (US)

(72) Inventor: John Manley McDonald, Folsom, CA (US)

( * ) Notice: Subject to any disclaimer, the term of this patent is extended or adjusted under 35 U.S.C. 154(b) by 47 days.

(21) Appl. No.: 16/225,959

(22) Filed: Dec. 19, 2018

(65) Prior Publication Data

US 2019/0186350 A1 Jun. 20, 2019

Related U.S. Application Data

(60) Provisional application No. 62/608,187, filed on Dec. 20, 2017.

(51) Int. Cl.
*F02B 35/02* (2006.01)
*F02B 39/02* (2006.01)
(Continued)

(52) U.S. Cl.
CPC ..... *F02B 35/02* (2013.01); *F02B 33/40* (2013.01); *F02B 39/02* (2013.01); *F02B 67/10* (2013.01); *F05D 2220/40* (2013.01)

(58) Field of Classification Search
CPC ..... F02B 39/02; F02B 67/10; F02B 33/40; F02B 35/00; F02B 35/02;
(Continued)

(56) References Cited

U.S. PATENT DOCUMENTS 2,898,731 A * 8/1959 Barr ..... F02B 37/10 60/606
3,498,052 A * 3/1970 Silvern ..... F02B 25/00 60/604
(Continued)

FOREIGN PATENT DOCUMENTS

CN 102155290 A * 8/2011 ..... F02B 37/04
DE 102012009319 B4 * 11/2018
(Continued)

OTHER PUBLICATIONS

WO-2015183064-A1 El Morabit M Hamed English Translation Dec. 2015 (Year: 2015).*
(Continued)

*Primary Examiner* — Laert Dounis
(74) *Attorney, Agent, or Firm* — Hamilton Patent Services LLC

(57) ABSTRACT

Described herein is a turbocharging system comprising a compressor having an air inlet and a compressed air outlet, the compressed air outlet to couple with the intake manifold of the internal combustion engine, a first turbine coupled to the compressor, the compressor driven without using power from the internal combustion engine; and a vacuum compressor coupled directly or indirectly to the first turbine. The first turbine can drive a common drive shaft that includes the compressor and the vacuum compressor or output of the first compressor can drive a second compressor that is coupled with the vacuum compressor. The vacuum compressor can be used to scavenge exhaust from the internal combustion engine.

21 Claims, 4 Drawing Sheets

(51) Int. Cl.
*F02B 67/10* (2006.01)
*F02B 33/40* (2006.01)

(58) Field of Classification Search
CPC ..... F02B 37/00–24; F02B 33/34–40; F02M 26/34; F02C 6/04; F02C 6/06; F02C 6/20; F05D 2220/40
See application file for complete search history.

(56) References Cited

U.S. PATENT DOCUMENTS 6,412,278 B1 * 7/2002 Matthews ..... F02B 37/18 60/605.1
6,450,156 B1 12/2002 Araujo
10,119,460 B2 * 11/2018 Primus ..... F02C 3/10
2002/0092300 A1 * 7/2002 Schmidt ..... B60T 13/585 60/602
2003/0121270 A1 * 7/2003 Kuo ..... F01D 5/025 60/791
2009/0241540 A1 * 10/2009 Robel ..... F01N 13/107 60/597
2013/0276443 A1 * 10/2013 Andrasko ..... F02D 9/06 60/602

FOREIGN PATENT DOCUMENTS

EP 1186767 A2 * 3/2002 ..... F02M 26/28
JP 2004060499 A * 2/2004 ..... F02M 26/34
WO WO-2014021700 A1 * 2/2014 ..... F02B 35/02
WO WO-2015183064 A1 * 12/2015 ..... F02B 35/02

OTHER PUBLICATIONS

JP-2004060499-A Aoyanagi, Yuzo English Translation Feb. 2004 (Year: 2004).*

* cited by examiner

EXTERNALLY POWERED TURBINE FOR AN INTERNAL COMBUSTION ENGINE

CROSS-REFERENCE

This application claims priority to U.S. Provisional Application No. 62/608,187 to John Manley McDonald, filed Dec. 20, 2017, which is hereby incorporated herein by reference.

FIELD

This application is directed towards an externally powered turbocharging system for an internal combustion engine.

BACKGROUND

Air compressors such as superchargers or turbochargers can be used to increase the amount of air within the cylinders of an internal combustion engine. This increase in air allows a greater amount of fuel to be burned, increasing the power output of the engine. Turbochargers are powered by the exhaust gases of an engine and typically includes a turbine and a compressor, which can be coupled via a common shaft. The rotation of the turbine causes the compressor to rotate, which compresses air entering the internal combustion engine. Superchargers include a compressor which is gear driven or belt driven by the internal combustion engine. The compressor can then compress air entering the internal combustion engine.

While turbochargers and superchargers can each significantly increase the power output of an internal combustion engine, each device has inherent drawbacks. Turbochargers use exhaust pressure from the internal combustion engine to spin the turbine wheels. The physical characteristics of the turbine wheel and housing impact the responsiveness and maximum power output of the turbocharger system. Selecting physical characteristics of a turbocharger system generally determining tradeoffs between responsiveness and power output, with higher power turbocharging systems being less responsive. Supercharger systems, being belt or gear driven by the internal combustion engine, can have improved responsiveness relative to turbocharger systems, potentially with reduced maximum output due to parasitic loss on the engine introduced by supercharger drive system. Additionally, even turbocharger systems can cause some degree of initial power loss to an engine due to increased back pressure during the exhaust cycle of the engine.

Air compression systems that seek to avoid the drawbacks of superchargers and turbochargers are known in the art, with some systems attempting to provide a supercharging or turbocharging system that is powered independently of the primary internal combustion engine to which the air compression system is connected. Such independently powered compression systems have not found wide-spread utilization in the auto industry, as existing independent air compressor systems are too large and/or heavy to enable practical integration into existing internal combustion engine designs or may not provide a sufficient performance and/or efficient advantage to warrant the additional weight or cost of integration.

SUMMARY

Described herein is an air compression system that can provide compressed air to an internal combustion engine while being powered separately from such engine. Rather than deriving power from the internal combustion engine, the system derives power from an external power source including but not limited to a gas turbine, gas generator, internal combustion engine, electric motor, compressed air motor, hydraulic motor, steam generator, etc. or any combination thereof. Additionally, the air compression system can be configured to both move and remove large volumes of a fluid from a specific, or multiple points within an attached internal combustion engine, improving engine efficiency by both pressurizing the intake tract and by assisting in the removal of exhaust gasses from the internal combustion engine. The system can be configured to apply a vacuum to the exhaust system of the internal combustion engine reducing or eliminating exhaust back pressure and preventing the buildup of exhaust manifold pressure. For example, diesel engines that are fitted with particulate filters and other emissions control components may experience reduced performance or efficiency due to the increased exhaust system backpressure caused by those systems. Such concerns may be overcome by the use of the exhaust vacuum system described herein. Additionally, the system designed herein may have particular applicability to high performance engine designers that wish to be able have a boost profile that is independent of the state of the internal combustion engine to which an associated turbocharger or supercharger is attached.

In one embodiment, the system includes a device having a compressor affixed to the intake tract of an internal combustion engine. The device can be configured to deliver a pre-determined quantity of air to the intake manifold of the internal combustion engine in order to increase the power output or efficiency of the internal combustion engine. Additionally, the device can have a secondary turbine that is configured as a vacuum compressor. The vacuum compressed can be affixed to the exhaust manifold of the engine and can create a vacuum to assist in the removal of any desired quantity of exhaust from the internal combustion engine. The exhaust vacuum can reduce exhaust back pressure on the engine, resulting in an increase in power output and/or efficiency of the internal combustion engine. The device may utilize any combination and any number of compressors and turbines of any design with either a fixed or variable geometry housing, adjustable nozzles to change or optimize flow characteristics, and or adjustable blade pitch in order to accomplish any task the device could be utilized. This device may be used in any application that requires both the delivery and removal of large quantities of a fluid to a specific point including but not limited to internal combustion engines of any design.

BRIEF DESCRIPTION OF THE FIGURES

So that the manner in which the above recited features of the present embodiments can be understood in detail, a more particular description of the embodiments, briefly summarized above, may be had by reference to embodiments, some of which are illustrated in the appended drawings. The appended drawings illustrate only typical embodiments, are not to be considered limiting as to all embodiments, and in which.

DETAILED DESCRIPTION

For the purposes of explanation, numerous specific details are set forth to provide a thorough understanding of the various embodiments described below. However, it will be apparent to a skilled practitioner in the art that the embodiments may be practiced without some of these specific details. In other instances, well-known structures and devices are shown in block diagram form to avoid obscuring the underlying principles, and to provide a more thorough understanding of embodiments. Although some of the following embodiments are described with reference to a graphics processor, the techniques and teachings described herein may be applied to various types of circuits or semiconductor devices, including general purpose processing devices or graphic processing devices. Reference herein to "one embodiment" or "an embodiment" indicate that a particular feature, structure, or characteristic described in connection or association with the embodiment can be included in at least one of such embodiments. However, the appearances of the phrase "in one embodiment" in various places in the specification do not necessarily all refer to the same embodiment.

In the following description and claims, the terms "coupled" and "connected," along with their derivatives, may be used. It should be understood that these terms are not intended as synonyms for each other. "Coupled" is used to indicate that two or more elements, which may or may not be in direct physical or electrical contact with each other, co-operate or interact with each other. "Connected" is used to indicate the establishment of communication between two or more elements that are coupled with each other.

Figure 1:
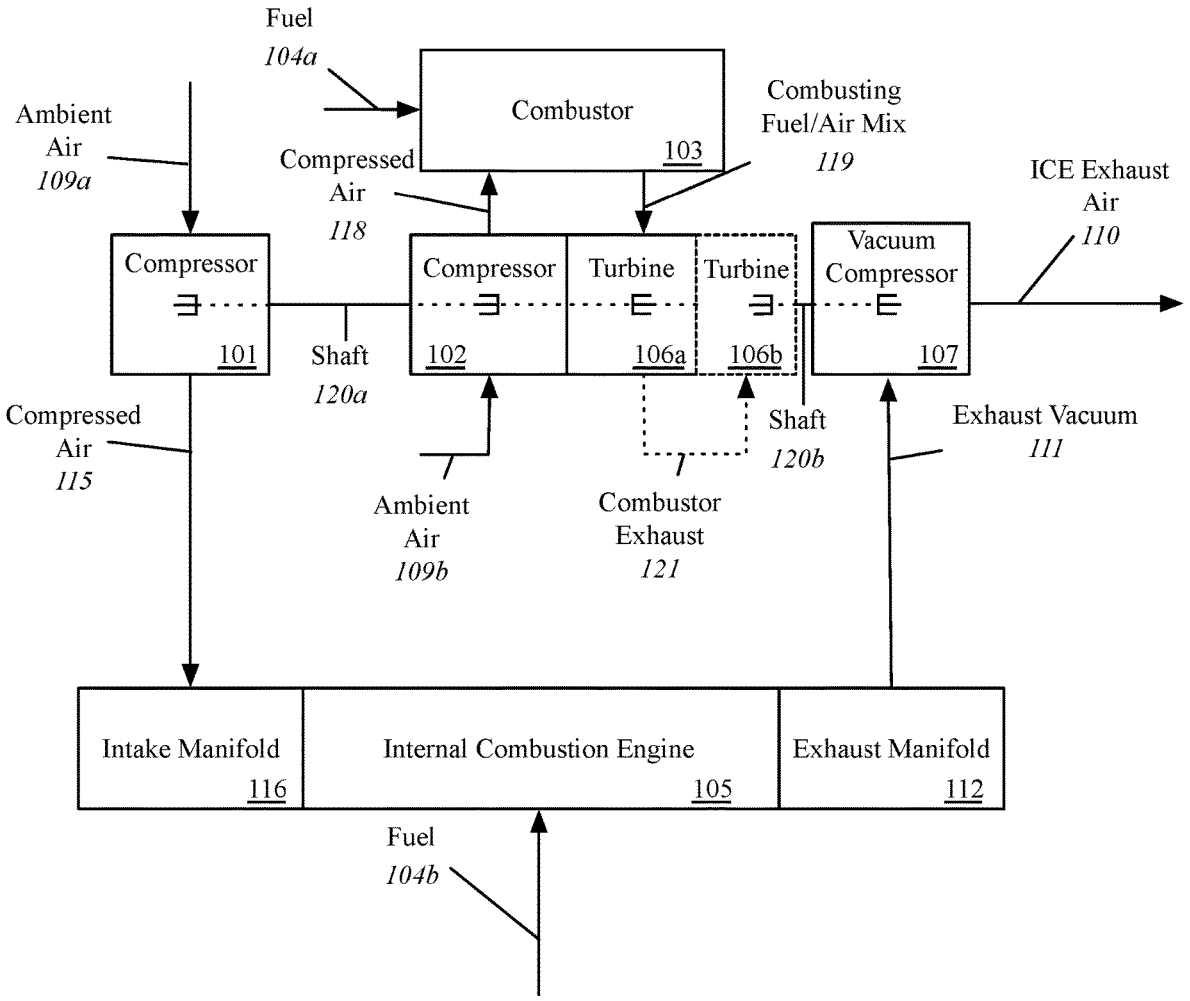
FIG. 1 is a schematic diagram of a turbocharging system according to embodiments described herein.

FIG. 1 is a schematic diagram of a turbocharging system according to embodiments described herein. One embodiment provides for a turbocharger system with an integrated gas turbine engine. The turbocharger system can be connected to a conventional internal combustion engine 105, which can be one of various types of internal combustion engines. The internal combustion engine 105 is connected with an intake manifold 116 through which intake air supply is received. The internal combustion engine 105 also connects to an exhaust manifold 112 in which exhaust gases are collected and output from the engine. The internal combustion engine 105 includes a fuel supply 104*b* that can be gasoline, diesel, or another type of fuel suitable for use within the internal combustion engine 105.

The turbocharger includes a turbine 106*a* that spins a shaft 120*a* connected to multiple compressors (compressor 101, compressor 102). Turbine 106*a* is spun by a pressurized fluid including a combusting fuel/air mixture 119 that is output from the combustor 103. A fuel supply 104*a* provides the combustor 103 with fuel. The fuel type may be the same or different as the fuel supply 104*b* used for the internal combustion engine 105. The supplied fuel can be any of a variety of fuels suitable for use within a gas turbine, including but not limited to Jet A, Jet A-1, Jet B, diesel, petrol, natural gas, kerosene, E85, biodiesel, biogas, or a mixture thereof.

In one embodiment, combustor exhaust 121 can be variably routed through turbine 106*b* or through a separate exhaust outlet. In one embodiment, instead of routing the combustor exhaust 121 through turbine 106*b*, turbine 106*b* can be excluded and the second shaft 120*b* can connect turbine 106*a* to vacuum compressor 107, such that a single common shaft 120 connects compressor 101, compressor 102, turbine 106*a*, and vacuum compressor 107. The common shaft 120 is connected to multiple compressors (compressor 101, compressor 102, vacuum compressor 107) for creating boost pressure (e.g., turning ambient air 109*a* into compressed air 115) as well as scavenging exhaust gases from the exhaust of the internal combustion engine (exhaust vacuum 111). Combustor exhaust 121 can then be output via a separate exhaust path.

The turbocharger can utilize engine vacuum on a compressor section to start the combustion process in a combustor 103. For example, during startup, the compressor 101 can act as a turbine to spin shaft 120*a*, causing compressor 102 to compress ambient air 109*b* into compressed air 118, which flows into the combustor 103.

Once combustion has begun in the combustion chamber, gasses pass through turbine 106*a*, which can accelerate shaft 120*a* to which compressor 102 and compressor 101 are connected. Once accelerated, the compressor 101 supplies the intake manifold 116 with pressurized air. In one embodiment, combustor exhaust 121, having spun turbine 106*a*, can be routed to turbine 106*b*, which is connected to a vacuum compressor 107 via a second shaft 120*b*. Vacuum compressor 107 can actively scavenge exhaust from the exhaust manifold 112, reducing back pressure on the engine by creating an exhaust vacuum 111. The internal combustion engine exhaust air 110 can then be output via a conventional exhaust pipe channel.

Figure 2:
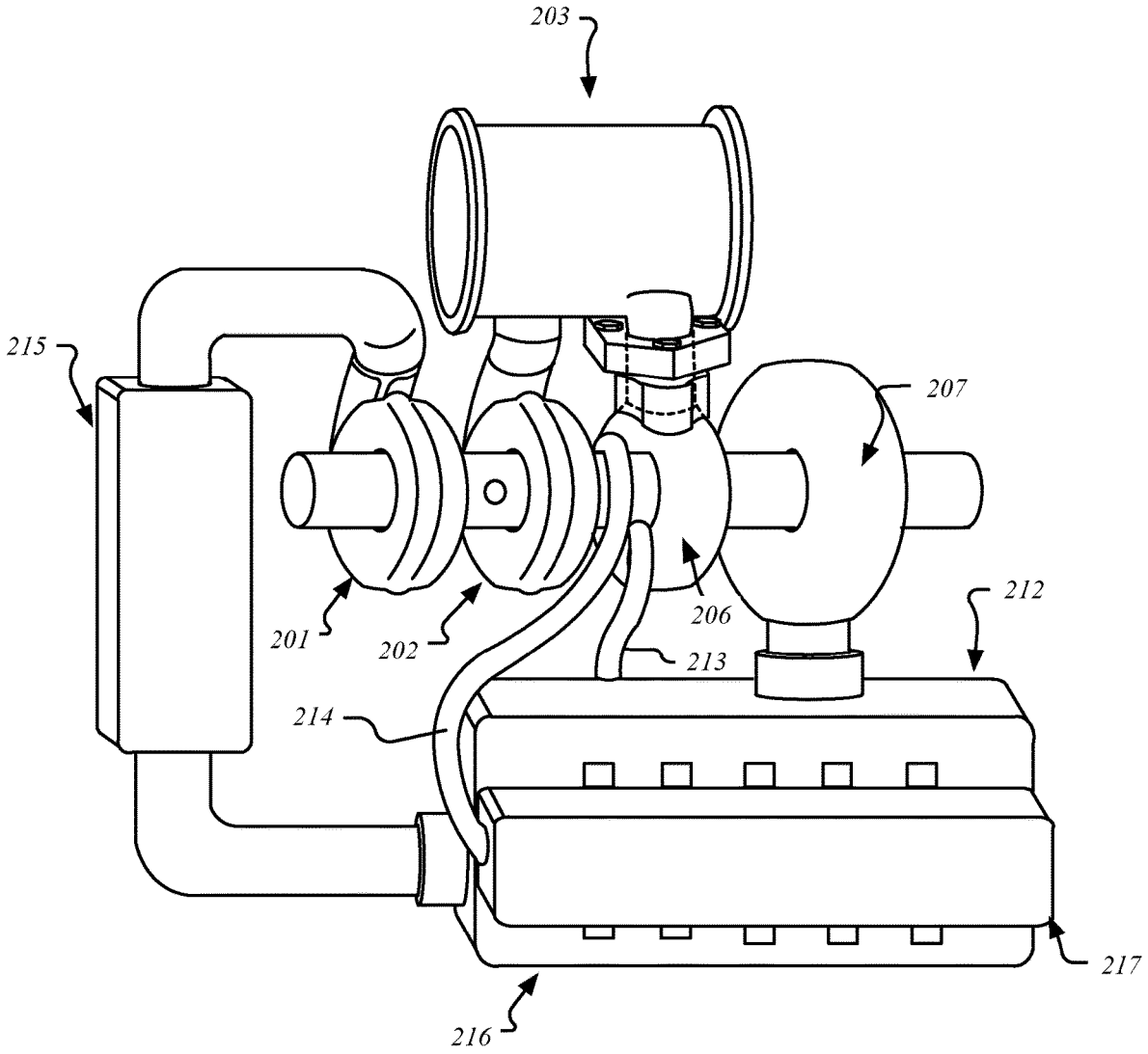
FIG. 2 is a schematic illustration a turbocharging system according to embodiments described herein.

FIG. 2 is a schematic illustration a turbocharging system according to embodiments described herein. In one embodiment a compressor within compressor housing 201 supplies compressed air to an internal combustion engine 217, while a second compressor within a second compressor housing 202 supplies compressed air to a combustor 203. The combustor 203 combusts fuel and compressed air to supply a high volume of air to a turbine within turbine housing 206. The turbine of turbine housing 206 can accelerate a common shaft that connects to the compressors of housing 201 and housing 202. Each housing can include a set of bearings to provide support and lubrication to the common shaft.

In one embodiment, compressed air output from compressor housing 201 can flow through an intercooler of heat exchanger 215 to reduce the temperature of the compressed air before the compressed air is supplied to the intake manifold 216 of the internal combustion engine 217. Exhaust gasses from the internal combustion engine 217 can flow into an exhaust manifold 212, which during operation is in a vacuum state due to operation of a vacuum compressor within housing 207. In one embodiment the internal combustion engine 217 provides an oil feed 214 and oil return 213 system by which engine oil of the internal combustion engine 217 is used to cool and lubricate the turbo system.

The illustrated configurations are representative of specific embodiments, and multiple configurations of turbines and compressors can be used.

Figure 3A:
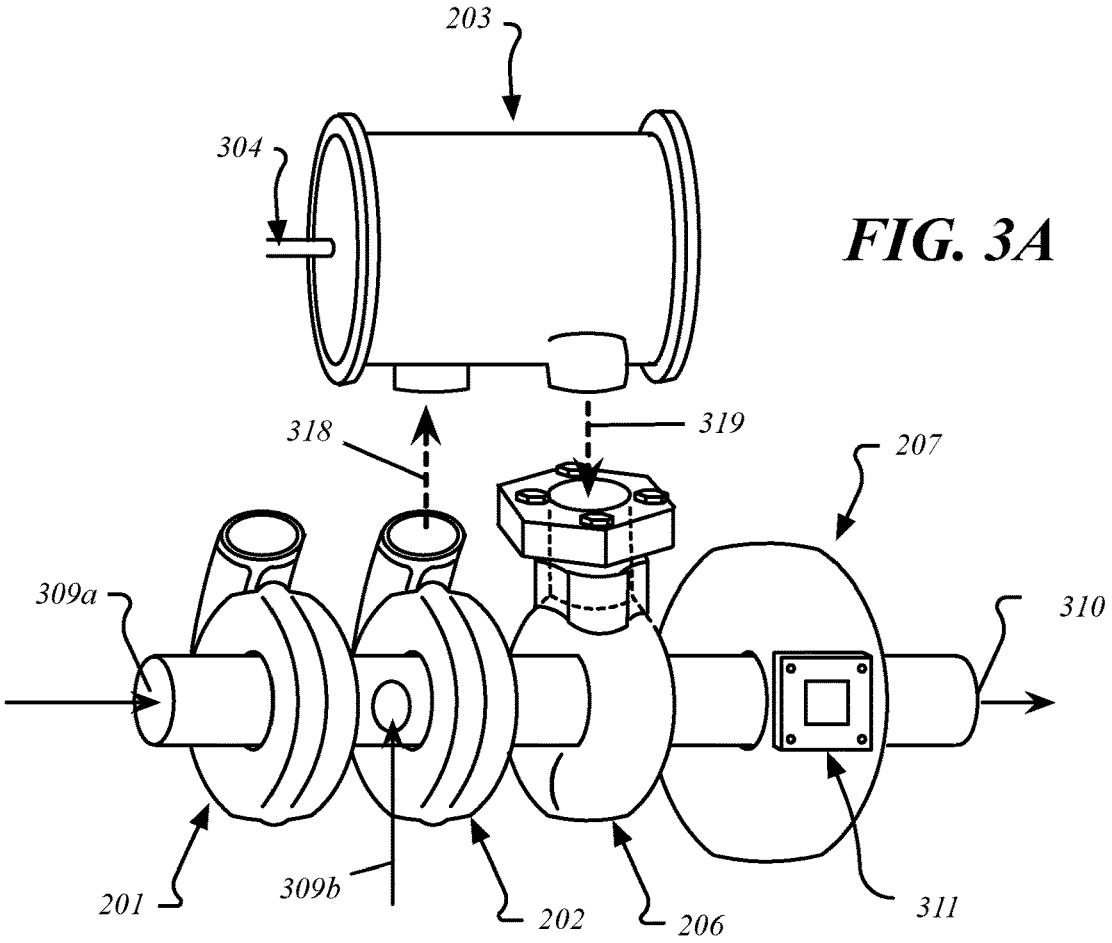
FIG. 3A-3B illustrates additional views and embodiments of the turbocharging system described herein.
Figure 3B:
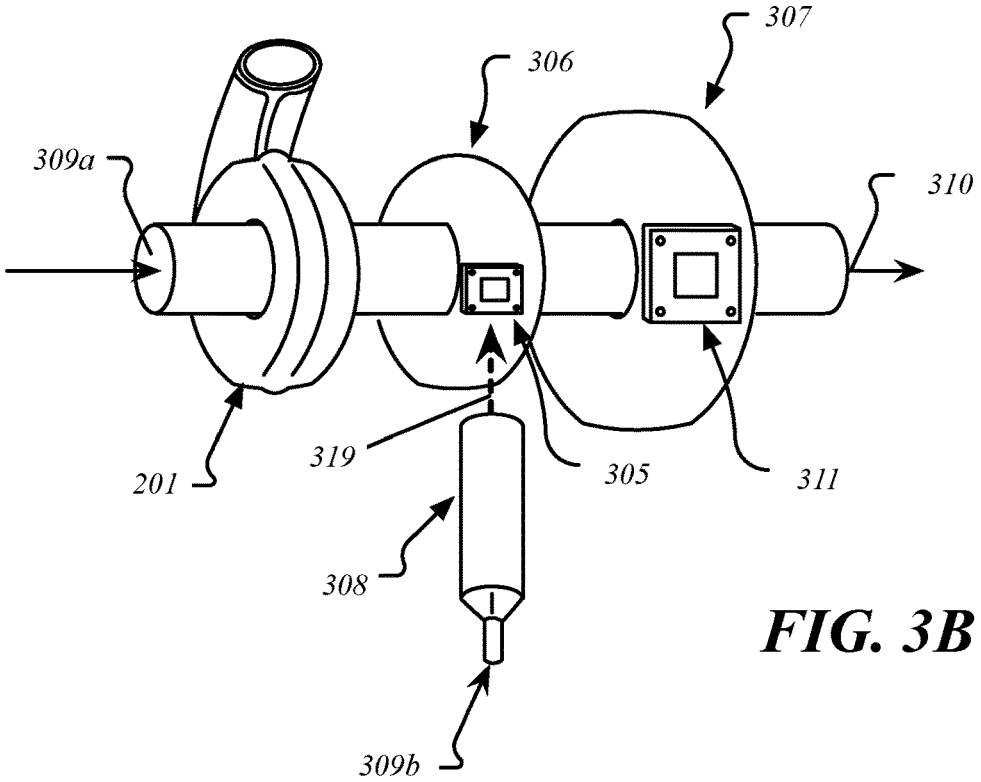

FIG. 3A-3B illustrates additional views and embodiments of the turbocharging system described herein. As shown in FIG. 3A, in one embodiment a fuel supply line 304 provides fuel to the combustor 203. Compressed air 318 is supplied to the combustor 203 via the compressor within housing 202, which can have a separate air intake 309*b* for ambient air than the air intake 309*a* for the compressor within housing 201. A flange 311 can be included within housing 207 to enable a connection to an internal combustion engine.

Housing 207 can also include an outlet 310 through which pressurized exhaust for the internal combustion engine is output.

As shown in FIG. 3B, in one embodiment a separate external turbine 308 can be used to provide compressed and/or pressurized air 319 to a turbine within housing 306 via a flange 305. The compressed and/or pressurized air 319 can be used to spin a shaft that connects the turbine of housing 306 and a turbine/vacuum compressor within housing 307.

Figure 4:
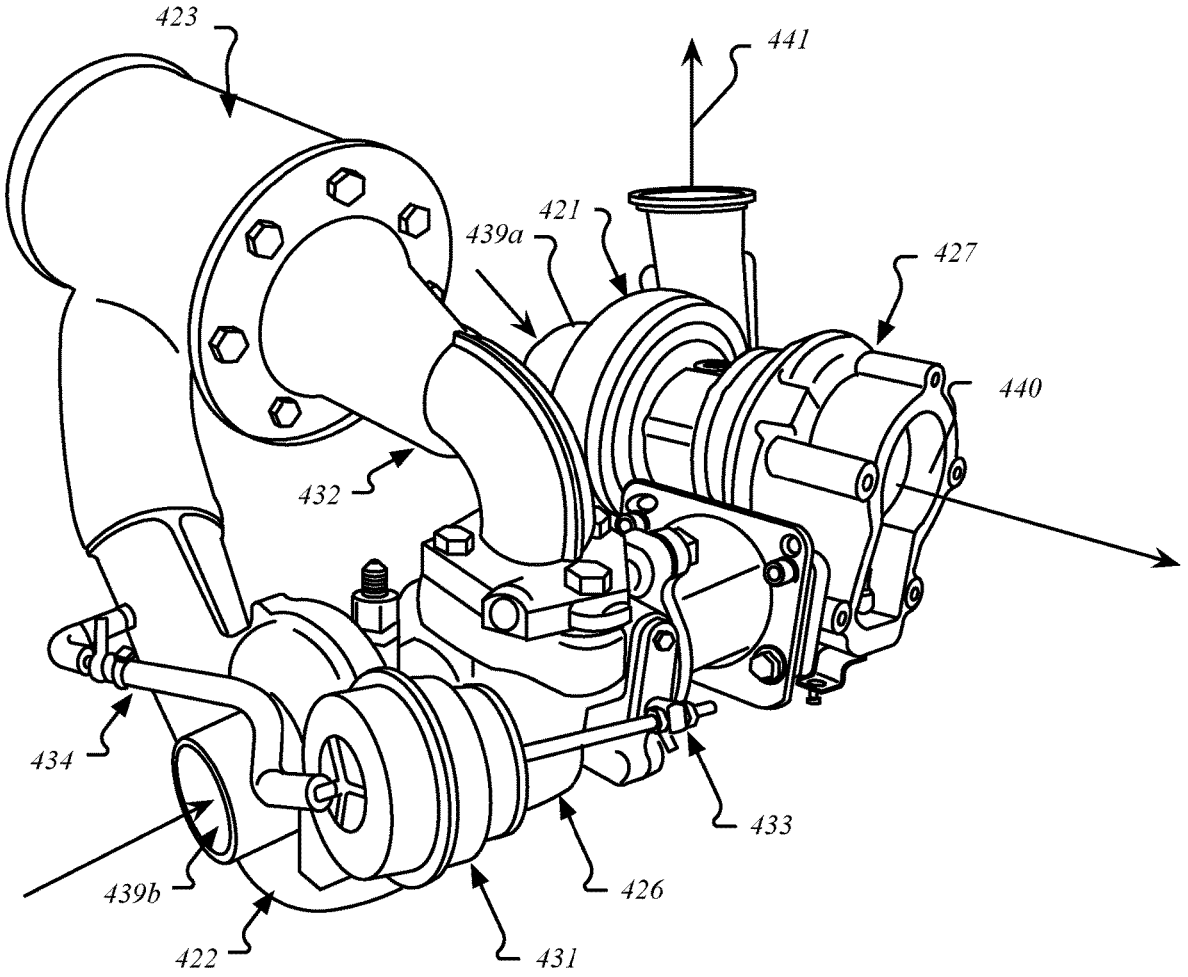
FIG. 4 illustrates a prototypical example of the turbocharging system described herein.

FIG. 4 illustrates a prototypical example of the turbocharging system described herein. The turbocharging system of FIG. 4 can be constructed in part using conventional turbocharger components. A compressor housing 422 including a compressor is coupled with a combustor 423 to create a gas turbine engine. The gas turbine engine can combust a fuel and compressed air mixture within a combustor 423. Fuel can be provided via a fuel supply (not shown) as with fuel supply line 304 in FIG. 3A and fuel supply 104*a* in FIG. 1. An ambient air inlet 439*b* can provide air to be compressed and fed into the combustor 423. The combusting fuel/air mixture in the combustor is then used to spin a turbine. The combustor 423 includes a combustor outlet 432 that feeds into a turbine housing 426 including a turbine impeller. The speed of the turbine impeller can be controlled via a wastegate or variable geometry turbine housing. The wastegate or variable geometry or variable nozzle turbine housing connection 433 can be actuated via a pressure-controlled actuator 431. In one embodiment, the pitch of the blades of the turbine may be adjustable, for example, where axial-flow turbines are used.

Pressure to control the pressure-controlled actuator can be provided via a feed line 434 that is tapped into the output section of the compressor housing 422. Output from turbine housing 426 can feed into a second turbine housing 427 to spin a second turbine, which is connected to a second compressor in a second compressor housing 421. The second compressor housing 421 can compress air that is drawn into an ambient air inlet 439*a* of the second compressor housing, which includes a compressor that provides compressed air via a compressed air outlet 441. The compressed air outlet 441 can connect to a heat exchanger or intercooler to cool the compressed air before the air is provided to an internal combustion engine Exhaust from the combustor can be output via a turbine exhaust outlet 440 that may be separate from the exhaust of an associated internal combustion engine. Exhaust scavenging can be enabled for the prototypical example via the addition of a vacuum compressor wheel to the shaft connecting the compressor impellers of the second turbine housing 427 and second compressor housing 421.

Those skilled in the art will appreciate from the foregoing description that the broad techniques of the embodiments can be implemented in a variety of forms. Various types of combustors can be utilized including can, annular and can annular combustors. The combustor may be positioned between the compressor and turbine or at a remote location. Additionally, the turbines and compressors described herein can axial flow, radial flow, centrifugal, or any combination thereof. In various embodiments, different types of fuels can be utilized including, but not limited to gasoline, propane, diesel oil, kerosene, hydrogen, Jet A, Jet A-1, Jet B, natural gas, E85, biodiesel, biogas, or a mixture thereof.

Described herein, in various embodiments, is a turbocharging system comprising a compressor having an air inlet and a compressed air outlet, the compressed air outlet to couple with the intake manifold of the internal combustion engine, a first turbine coupled to the compressor, the compressor driven without using power from the internal combustion engine; and a vacuum compressor coupled directly or indirectly to the first turbine. The first turbine can drive a common drive shaft that includes the compressor and the vacuum compressor or output of the first compressor can drive a second compressor that is coupled with the vacuum compressor. The vacuum compressor can be used to scavenge exhaust from the internal combustion engine.

Furthermore, the concepts described herein can be applied to various types of internal combustion engines, including those that can be used in automobiles, aircraft, boats, and other types of applications. Thus, in addition to the turbocharging system described herein, an engine apparatus is also provided, where the engine apparatus comprises an internal combustion engine having an intake manifold and an exhaust manifold, a compressor having an air inlet and a compressed air outlet, the compressed air outlet to couple with the intake manifold of the internal combustion engine, a first turbine coupled to the compressor, the compressor driven without using power from the internal combustion engine, and a vacuum compressor driven via the first turbine, the vacuum compressor to scavenge exhaust from the exhaust manifold of the internal combustion engine. Other details can be similar to the turbocharger system described herein.

The engine apparatus can be employed within vehicles of various types. One embodiment provides for a vehicle powered by an internal combustion engine having an intake manifold and an exhaust manifold, the vehicle comprising a compressor having an air inlet and a compressed air outlet, the compressed air outlet to couple with the intake manifold of the internal combustion engine, a first turbine coupled to the compressor, the compressor driven without using power from the internal combustion engine, and a vacuum compressor driven via the first turbine, the vacuum compressor to scavenge exhaust from the exhaust manifold of the internal combustion engine. The vacuum compressor can be directly or indirectly driven by the first turbine.

Therefore, while the embodiments have been described in connection with particular examples thereof, the true scope of the embodiments should not be so limited since other modifications will become apparent to the skilled practitioner upon a study of the drawings, specification, and following claims.

What is claimed is:

1. A turbocharging system comprising:

a compressor having an air inlet and a compressed air outlet, the compressed air outlet to couple with an intake manifold of an internal combustion engine;

a first turbine coupled to the compressor and fluidly independent of the internal combustion engine, the first turbine including a gas coupling with a combustor, wherein the first turbine is positioned to be driven by gas output from the combustor and the combustor is external to the internal combustion engine; and a vacuum compressor driven via the first turbine, the vacuum compressor positioned to scavenge exhaust gas from the internal combustion engine and output the exhaust gas via an exhaust channel.

2. The turbocharging system as in claim 1, wherein the vacuum compressor is coupled with the first turbine by a drive shaft.

3. The turbocharging system as in claim 1, wherein the vacuum compressor is driven indirectly via the first turbine, the vacuum compressor is coupled with a second turbine by a drive shaft, and the second turbine has a gas coupling for receiving exhaust gas from the first turbine.

4. The turbocharging system as in claim 3, wherein one of the first turbine and the second turbine are radial turbines.

5. The turbocharging system as in claim 4, wherein one of the first turbine and the second turbine have a variable nozzle or variable geometry.

6. The turbocharging system as in claim 1, wherein one of the compressor and the vacuum compressor are axial compressors.

7. The turbocharging system as in claim 1, wherein the compressor comprises a first compressor and a second compressor, the first compressor is coupled with the second compressor via a drive shaft, the second compressor is positioned to compress ambient air into the combustor, and the vacuum compressor is positioned to apply a vacuum to an exhaust manifold of the internal combustion engine.

8. The turbocharging system as in claim 7, wherein the combustor is a can combustor.

9. The turbocharging system as in claim 7, wherein a fuel supply of the combustor is separate from the fuel supply of the internal combustion engine.

10. An engine apparatus, comprising:

an internal combustion engine having an intake manifold and an exhaust manifold;

a compressor having an air inlet and a compressed air outlet, the compressed air outlet to couple with the intake manifold of the internal combustion engine;

a first turbine coupled to the compressor and fluidly independent of the internal combustion engine, the first turbine including a gas coupling with a combustor, wherein the first turbine is positioned to be driven by gas output from the combustor and the combustor is external to the internal combustion engine; and a vacuum compressor driven via the first turbine, the vacuum compressor positioned to scavenge exhaust gas from the internal combustion engine and output the exhaust gas via an exhaust channel.

11. The engine apparatus as in claim 10, wherein the vacuum compressor is coupled with the first turbine by a drive shaft.

12. The engine apparatus as in claim 10, wherein the vacuum compressor is driven indirectly via the first turbine, the vacuum compressor is coupled with a second turbine by a drive shaft, and the second turbine has a gas coupling for receiving exhaust gas from the first turbine.

13. The engine apparatus as in claim 12, wherein one of the first turbine and the second turbine are radial turbines.

14. The engine apparatus as in claim 13, wherein one of the first turbine and the second turbine have a variable nozzle or variable geometry.

15. The engine apparatus as in claim 10, wherein one of the compressor and the vacuum compressor are axial compressors.

16. The engine apparatus as in claim 10, wherein the compressor comprises a first compressor and a second compressor, the first compressor is coupled with the second compressor via a drive shaft, the second compressor is positioned to compress ambient air into the combustor, and the vacuum compressor is positioned to apply a vacuum to the exhaust manifold of the internal combustion engine.

17. The engine apparatus as in claim 16, wherein the combustor is a can combustor and a fuel supply of the combustor is separate from the fuel supply of the internal combustion engine.

18. A vehicle powered by an internal combustion engine having an intake manifold and an exhaust manifold, the vehicle comprising:

a compressor having an air inlet and a compressed air outlet, the compressed air outlet to couple with the intake manifold of the internal combustion engine;

a first turbine coupled to the compressor and fluidly independent of the internal combustion engine, the first turbine including a gas coupling with a combustor, wherein the first turbine is positioned to be driven by gas output from the combustor and the combustor is external to the internal combustion engine; and a vacuum compressor driven via the first turbine, the vacuum compressor positioned to scavenge exhaust gas from the exhaust manifold of the internal combustion engine and output the exhaust gas via an exhaust channel.

19. The vehicle as in claim 18, wherein the vacuum compressor is coupled with the first turbine by a drive shaft.

20. The vehicle as in claim 18, wherein the vacuum compressor is driven indirectly via the first turbine, the vacuum compressor is coupled with a second turbine by a drive shaft, and the second turbine has a gas coupling for receiving exhaust gas from the first turbine.

21. The vehicle as in claim 18, wherein the vacuum compressor is positioned to apply a vacuum to the exhaust manifold of the internal combustion engine.

* * * * *